US010646016B2

(12) United States Patent
Alvarez

(10) Patent No.: US 10,646,016 B2
(45) Date of Patent: May 12, 2020

(54) HAIR GRID MEASURING DEVICE AND METHOD

(71) Applicant: Antonio Xavier Alvarez, Chicago, IL (US)

(72) Inventor: Antonio Xavier Alvarez, Chicago, IL (US)

( * ) Notice: Subject to any disclaimer, the term of this patent is extended or adjusted under 35 U.S.C. 154(b) by 431 days.

(21) Appl. No.: 14/819,668

(22) Filed: Aug. 6, 2015

(65) Prior Publication Data

US 2017/0035178 A1 Feb. 9, 2017

(51) Int. Cl.
*A45D 27/42* (2006.01)
*A45D 24/36* (2006.01)

(52) U.S. Cl.
CPC ..... *A45D 27/42* (2013.01); *A45D 24/36* (2013.01)

(58) Field of Classification Search
CPC ..... A45D 24/36; A45D 27/42; A45D 27/00; A45D 40/30; A45D 44/002; A45D 44/12; A45D 44/08
USPC ..... 132/213, 214, 213.1; D28/44.2, 44; 33/512; 434/87, 90
See application file for complete search history.

(56) References Cited

U.S. PATENT DOCUMENTS 1,301,092 A * 4/1919 Bernard ..... B43L 7/0275 33/477
1,850,540 A * 3/1932 Erickson ..... A45D 44/12 132/216
2,749,922 A * 6/1956 Daniel et al. ..... A45D 24/36 132/214
2,879,778 A * 3/1959 Peck ..... A45D 24/36 132/214
3,327,391 A * 6/1967 Malm ..... A61C 19/006 206/527
3,795,053 A * 3/1974 Burke ..... B43L 9/002 33/1 B
4,087,917 A * 5/1978 Sheerer ..... B43L 7/00 33/448
4,619,280 A * 10/1986 Yampolskaya ..... A45D 24/36 132/214
4,886,079 A * 12/1989 Mooney ..... A45D 40/00 132/319
4,957,124 A * 9/1990 Mooney ..... A45D 40/00 132/200
5,427,122 A * 6/1995 Hamilton ..... A45D 24/36 132/214

(Continued)

*Primary Examiner* — Tatiana L Nobrega
(74) *Attorney, Agent, or Firm* — Rockman Videbeck & O'Connor

(57) ABSTRACT

A hair grid measuring device comprises a thin, flexible body, a first side opposite a second side, a third side opposite a fourth side, a plurality of horizontal grid lines extending from the first side to the second side, and a plurality of vertical grid lines extending from the third side to the fourth side. The thin, flexible body also includes a plurality of apertures holding the device against a first individual's skin, ensuring stability and leverage, and easily bending the grid measuring device to the contours of the first individual's face, head, and body. A method for creating a custom hair style using the hair grid measuring device, accomplished either by hand or via a software application on an electronic device, that allows the first individual to obtain the hair design of a second individual, such as a celebrity, sports player, or actor, or any predetermined shape.

9 Claims, 12 Drawing Sheets

(56) References Cited

U.S. PATENT DOCUMENTS 6,925,724 B2 * 8/2005 Tandy ..... D05B 97/12 33/1 B
7,185,441 B2 * 3/2007 Lockyer ..... B26B 29/06 33/562
7,222,629 B1 * 5/2007 Han ..... A41G 5/02 132/216
7,252,094 B2 * 8/2007 Maynard ..... A45D 24/36 132/214
7,409,958 B1 * 8/2008 Vacker ..... A45D 24/36 132/214
D601,442 S * 10/2009 Haren ..... D10/64
7,770,303 B2 * 8/2010 Graham ..... D05B 97/12 33/562
8,161,658 B1 * 4/2012 Hackworth ..... D06H 7/00 33/562
8,365,744 B1 * 2/2013 Branch ..... A45D 24/36 132/200
8,783,267 B2 7/2014 Allen
8,904,661 B1 * 12/2014 Norgard ..... G01B 3/04 33/1 B
D733,963 S * 7/2015 Dossett ..... D11/27
D785,869 S 5/2017 Esnard
2004/0163269 A1 * 8/2004 Brady ..... G01B 3/002 33/562
2009/0025245 A1 * 1/2009 Brady ..... B26B 29/06 33/562
2009/0223530 A1 * 9/2009 Chapman ..... A45D 27/42 132/200
2010/0223798 A1 * 9/2010 Zimmerman ..... B43L 7/027 33/494
2012/0085361 A1 * 4/2012 Tokko ..... A41G 5/0086 132/53
2013/0087164 A1 * 4/2013 Thomas ..... A45D 44/00 132/200
2013/0213429 A1 * 8/2013 Allen ..... A45D 24/36 132/214
2015/0027484 A1 * 1/2015 Narbut ..... A45D 19/0008 132/208
2016/0309876 A1 * 10/2016 Brunett ..... A45D 24/02
2017/0027297 A1 * 2/2017 Cover ..... A45D 24/36

* cited by examiner

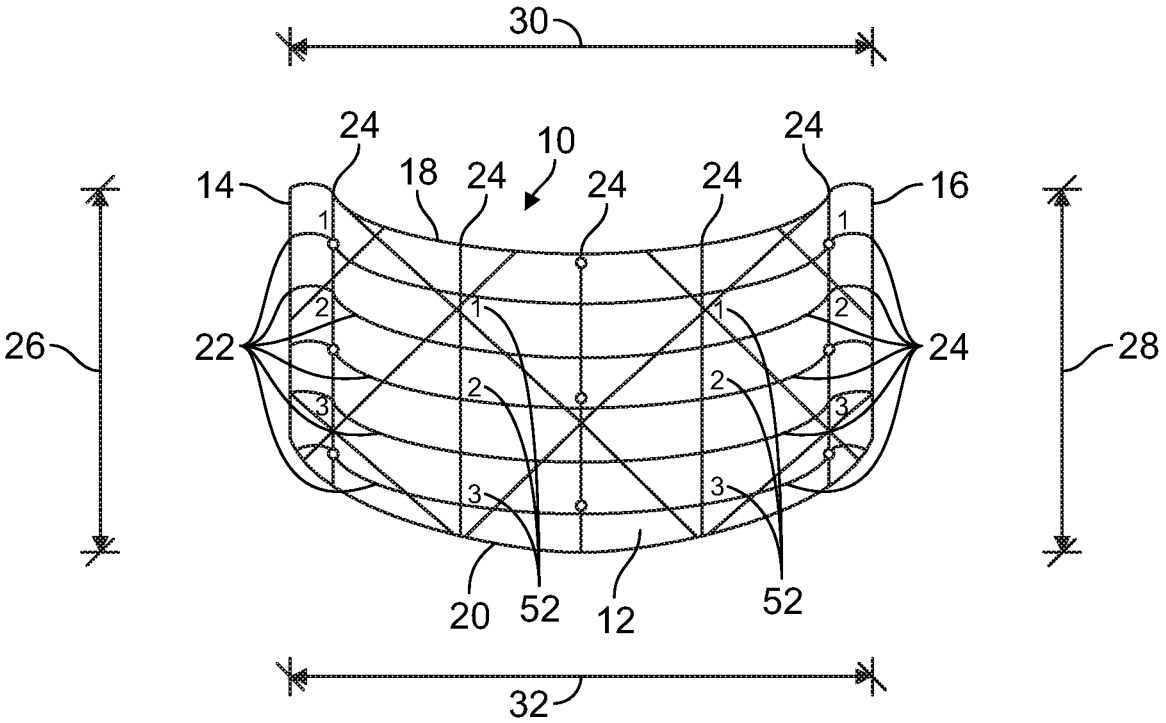
FIG. 1
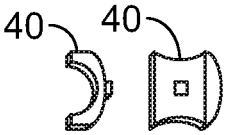
FIG. 2D
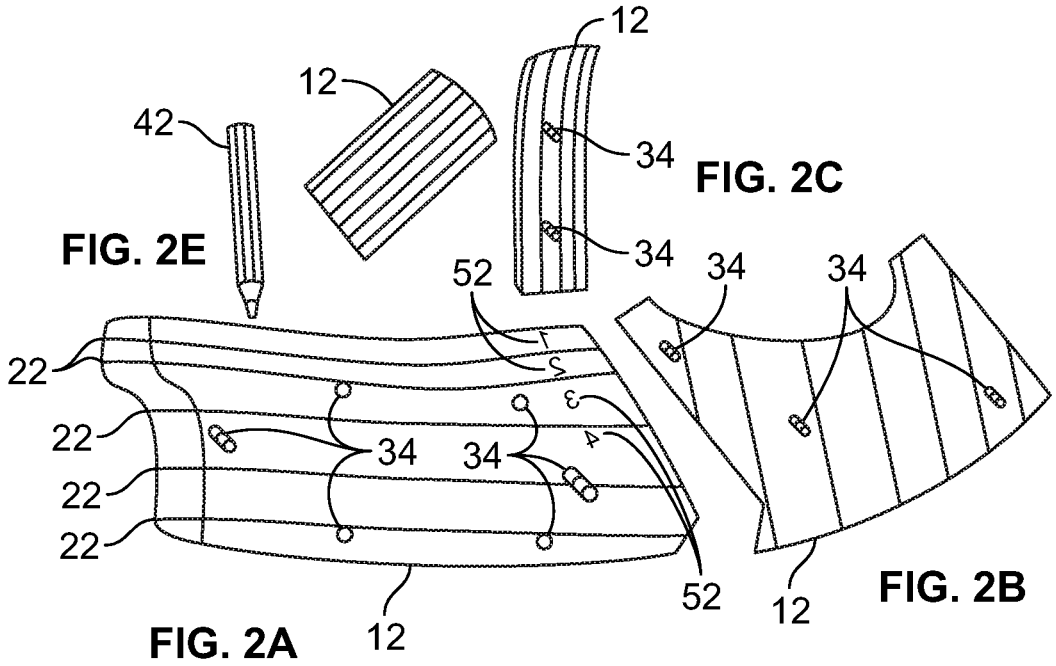
FIG. 2E
FIG. 2C
FIG. 2A
FIG. 2B

FIG. 3A
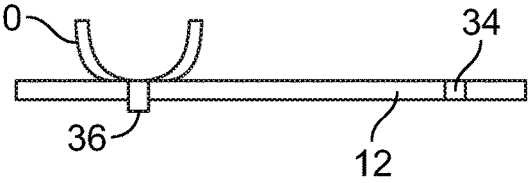
FIG. 3B
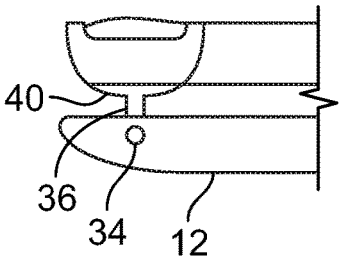
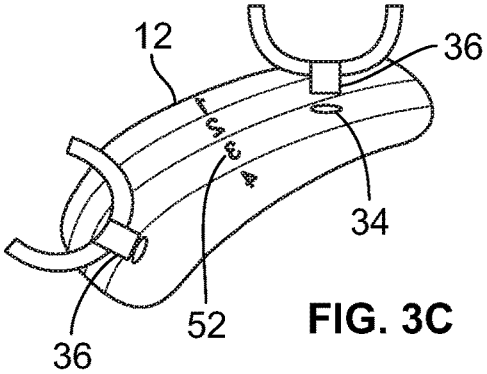
FIG. 3C
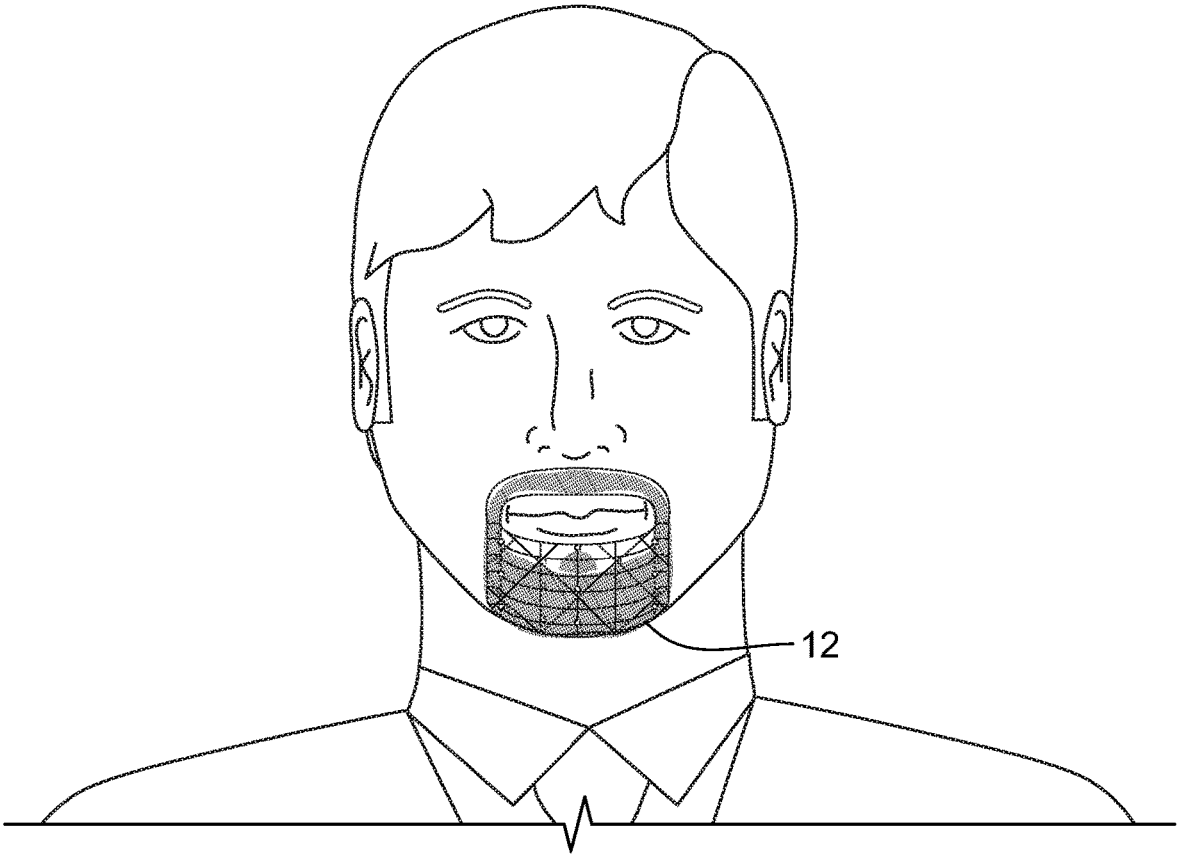
FIG. 4

HAIR GRID MEASURING DEVICE AND METHOD

BACKGROUND OF THE INVENTION

Field of the Invention

The present invention relates generally to a hair grid measuring device, and more particularly, to a hair grid measuring device and method that facilitates and ensures that the first individual obtains a symmetric and/or asymmetric shave on either side of the face and/or part of the body.

Description of the Prior Art

Hair shaving and trimming guides are well known in the art. The shaving and trimming guides of the past have focused mainly on providing a clean line to shave and measurement markings in an effort to achieve hair symmetry or asymmetry from one side of the face to the other side of the face. The guides are not transparent or translucent and the measurement markings are etched only along the outer perimeter of the guides, making it difficult to measure the skin that is under the guide to achieve a continuous, even shave symmetrical to both sides of the first individual's face. In addition, the prior art does not disclose numbers, symbols, letters, and/or indicia. The prior art also does not disclose numbers, symbols, letters, and/or indicia that can be reversed to provide the user with a readable, mirrored reflection. Furthermore, the guides of the prior art do not allow the user to shave virtually any design onto the user's face and/or head.

U.S. Pat. No. 8,783,267 discloses a hair trimming guide that provides four edges that allow a person to easily trim or shape their hair, such as a beard, by following the edges of the hair trimming guide. The hair trimming guide is flat and smooth which enables it to be pressed against a user's face without causing discomfort. The hair trimming guide can be constructed out of rigid materials to aid in keeping a steady edge when shaping and trimming facial hair. The hair trimming guide can also be constructed out of flexible materials, such as certain plastics, that allow the user to more comfortably press the flat main body against their face. However, patent '267 discloses that a flexible main body sacrifices some usability for comfort because a flexible body will be more difficult to use as a guide when compared to a rigid body. The hair trimming guide includes two curved edges and two straight edges. Each edge includes a plurality of measurement markings that allow a user to better manage and duplicate the trimmed areas on either side of the face. Although patent '267 discloses measurement markings, the hair trimming guide is not transparent or translucent and those markings are not continuous throughout the main body to guide the user through the area of skin that is under the hair trimming guide. Furthermore, patent '267 does not disclose apertures for the user's fingers adapted to provide the user with an easier way to grip and pull the skin to maintain a close, even shave.

U.S. Patent Application Publication 2009/0223530 discloses a facial hair trimming template and method that includes right and left template members. The right and left members have a first predetermined shape and a first predetermined size for placement over predetermined left and right facial regions of a user. The right and left members are mirror images of each other and each has a front side and a back side. A securing means is engageable with the right and left members and at least one of a user's face, such as the user's facial hair, ears, and head. It is preferred that such securing means be an adhesive type of securing means. The facial hair trimming template further includes a connecting means engaged with the right and left members at predetermined locations thereon for at least one of extending between the right and left members, connecting the right and left members, and a combination thereof. Although publication '530 discloses a trimming template, the trimming template is not transparent or translucent and does not include measurement markings that would guide the user through the area of skin that is under the trimming template.

The prior art to date does not disclose a hair grid measuring device and method that provides measuring lines throughout a transparent or translucent body to ensure that the shape and shave are symmetrical from one side of the face to the other, and provides a more accurate and precise design. Furthermore, none of the prior art to date provides a shaving guide and method customized to duplicate the hair of certain celebrities and/or athletes or a previous style of the first individual. None of the prior art can be combined in a way to suggest these necessary modifications. There is no teaching, suggestion, or motivation that would have enabled a person of ordinary skill in the art to modify any prior art hair trimming guide in the manner embodied in the present invention.

It is a primary object of the present invention to provide a hair grid measuring device that is transparent or translucent so the first individual can see through the body of the device.

Another object of the present invention is to provide a hair grid measuring device that includes markings and grid lines throughout the body of the device.

Still another object of the present invention is to provide a hair grid measuring device that allows the first individual to see through the transparent or translucent body of the device to ensure that the shaving follows the measuring grid and is consistent throughout the device.

Still another object of the present invention is to provide a hair grid measuring device that allows the first individual to duplicate the shape of the hair from one side of the face to the other.

Still another object of the present invention is to provide a hair grid measuring device that allows the first individual to duplicate the hair of a specific celebrity and/or sports player or a previous style of the first individual.

Still another object of the present invention is to provide a method for using the hair grid measuring device that allows the first individual to obtain the hair design of a second individual, such as a celebrity, sports player, actor and/or a previous style of the first individual.

Still another object of the present invention is to provide a hair grid measuring device that includes finger holes and/or other apertures that allow the first individual to hold the hair grid measuring device against the skin in a secure way.

Still another object of the present invention is to provide a hair grid measuring device that includes numbers, symbols, letters, and/or indicia that aid the first individual in shaving custom symmetrical and/or asymmetrical styles and/or images.

Still another object of the present invention is to provide a hair grid measuring device that includes numbers, symbols, letters, and/or indicia that can be printed or inscribed in an inverted manner on the hair grid measuring device, allowing the first individual to see readable, reinverted numbers, symbols, letter, and/or indicia when looking at a mirrored reflection of the first individual when using the hair grid measuring device.

SUMMARY OF THE INVENTION

The hair grid measuring device of the present invention, in a first embodiment, comprises a thin, flexible body, a first side opposite a second side, a third side opposite a fourth side, a plurality of horizontal grid lines extending from the first side to the second side, and a plurality of vertical grid lines extending from the third side to the fourth side. The first side has a first length and the second side has a second length. The third side has a third length and the fourth side has a fourth length. The third length and the fourth length are longer than the first length and the second length. The first side, second side, third side, and fourth side can have either a straight edge or a curved edge. In a second embodiment, the hair grid measuring device comprises a thin, flexible body formed as any shape, allowing a first individual to shave virtually any design. In a third embodiment, the hair grid measuring device comprises a three dimensional thin, flexible body that includes curves throughout the body, forming pockets that cover an increased amount of hair, thereby allowing the user to grow more hair in certain areas. In a fourth embodiment, the hair grid measuring device includes at least one inverted number, symbol, letter, and/or indicia along making it suitable for the first individual to read number, symbol, letter, and/or indicia correctly in the minor.

A method used to create a custom hair style using the hair grid measuring device and accomplished either by hand or via a software application on an electronic device, such as a mobile electronic device or a computer. The method comprises the steps of obtaining an image of a first individual, superimposing a grid having a plurality of points onto the image, assigning a plurality of indicia to the image based on the dimensions of the first individual's face, head, or body part to be shaved, measuring the distance between each indicia and creating a scale using the measurements, selecting the hair template of a second individual or a predetermined shape, and adjusting the hair template to the dimensions of the first individual's face, head, or body part to be shaved based on the scale.

The adjusted hair template is then superimposed onto a flexible material and a hair grid measuring device is generated from the flexible material having a perimeter based on the dimensions of the adjusted hair template. Alternatively, the adjusted hair template is superimposed onto a hair grid measuring device and a combination of indicia is determined from the plurality of indicia along the grid lines of the hair grid measuring device, the combination of indicia outlining a perimeter based on the dimensions of the adjusted hair template. The hair grid measuring device is then placed onto the first individual's face to facilitate cutting, trimming, or shaving the hair of the first individual, along the perimeter of the hair grid measuring device or along the perimeter outlined by the combination of indicia on the hair grid measuring device.

BRIEF DESCRIPTION OF THE DRAWINGS

The present invention is further described with reference to the accompanying drawings in which:

FIG. 1 is a front plan view of a first embodiment of the chin grid of the hair grid measuring device of the present invention.

FIG. 2*a* is a front plan view of the first embodiment of the jaw grid of the hair grid measuring device of the present invention.

FIG. 2*b* is a front plan view of the first embodiment of the chin grid of the hair grid measuring device of the present invention.

FIG. 2*c* is a front plan view of the first embodiment of the sideburn grid of the hair grid measuring device of the present invention.

FIG. 2*d* is a side plan view of the first embodiment of the fingertip holders of the hair grid measuring device of the present invention.

FIG. 2*e* is a side plan view of the first embodiment of the water soluble writing device of the hair grid measuring device of the present invention.

FIG. 3*a* is a side plan view of the first embodiment of the fingertip holder of the hair grid measuring device of the present invention.

FIG. 3*b* is a side plan view of the first embodiment of the fingertip holder of the hair grid measuring device of the present invention when a first individual's finger is placed in the holder.

FIG. 3*c* is a top perspective view of the first embodiment of the fingertip holder, placed on the jaw grid, of the hair grid measuring device of the present invention.

FIG. 4 is a front perspective view of the first embodiment of the chin grid of the hair grid measuring device when placed on the first individual's chin.

DETAILED DESCRIPTION OF THE ILLUSTRATED EMBODIMENTS

Figure 5A:
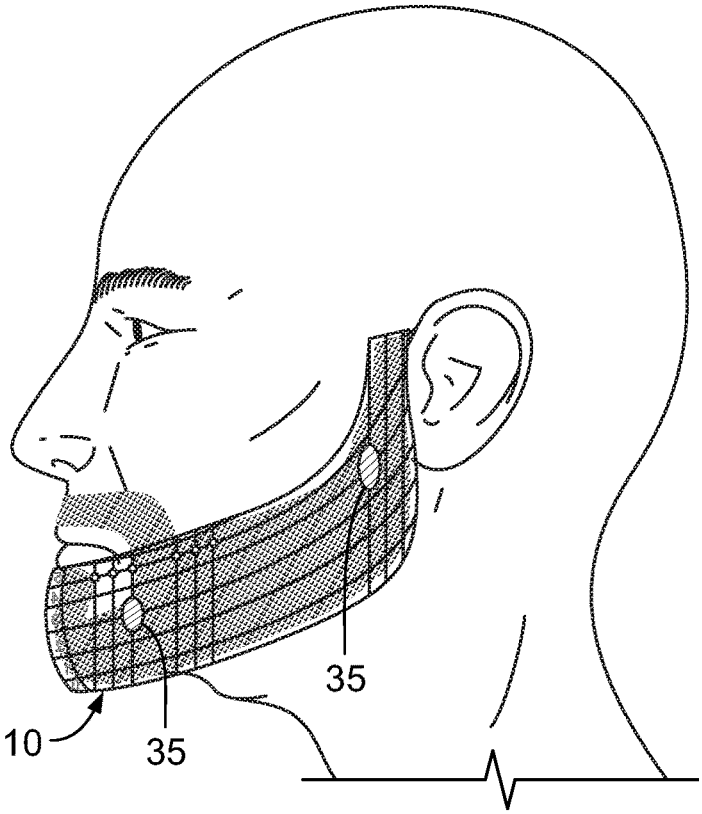
FIG. 5*a* is a side perspective view of the first embodiment of the chin grid of the hair grid measuring device having at least two apertures with a larger diameter to accommodate the first individual's fingers.

The hair grid measuring device 10 of a first embodiment of the present invention, shown in FIG. 1, comprises a thin, flexible body 12, a first side 14 opposite a second side 16, a third side 18 opposite a fourth side 20, a plurality of horizontal grid lines 22 extending from the first side 14 to the second side 16, and a plurality of vertical grid lines 24 extending from the third side 18 to the fourth side 20. The first side 14 has a first length 26, the second side 16 has a second length 28, the third side 18 has a third length 30, and the fourth side 20 has a fourth length 32. In a first embodiment, the third length 30 and the fourth length 32 are longer than the first length 26 and the second length 28. The first side, second side, third side, and fourth side can have a straight edge or a curved edge. A curved edge allows the device 10 to follow the hair perimeter or the contours of a first individual's face or head. The perimeter of the hair grid measuring device 10 can be ridged to allow for a closer shave. Additionally, the hair grid measuring device 10 can also include a plurality of curved lines 23, shown in FIG. 10.

Figure 6:
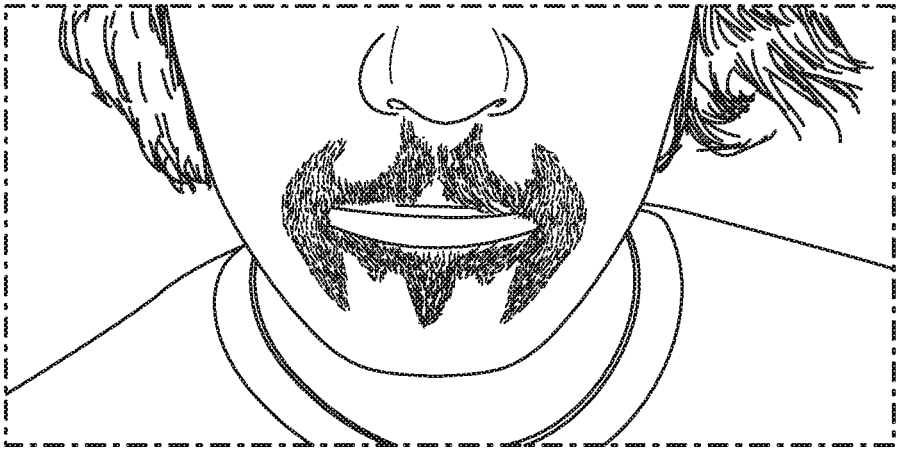
FIG. 6 is a front view of a hair design shaved onto the first individual's face, head, or body using a second embodiment of the hair grid measuring device of the present invention.
Figure 7:
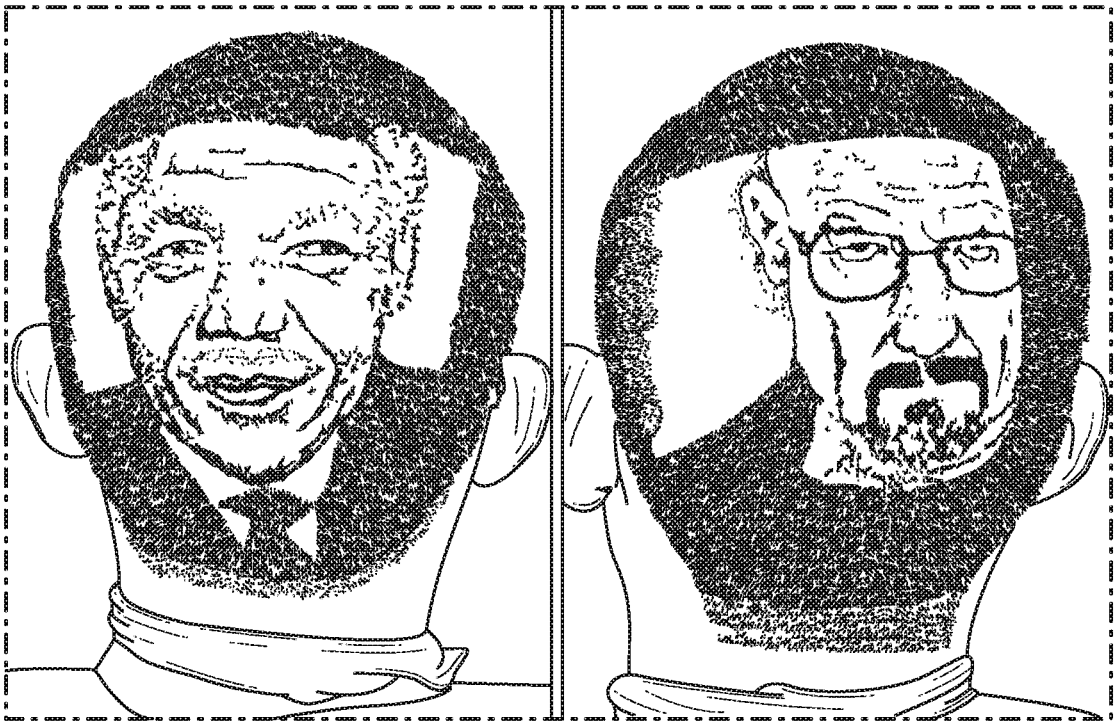
FIG. 7 is a front view of a hair design shaved onto the first individual's head using the second embodiment of the hair grid measuring device of the present invention.

In a second embodiment of the present invention, the hair grid measuring device 10 comprises a thin, flexible body formed as any predetermined shape, thereby allowing the first individual to shave, cut, or trim facial, head, or body hair into virtually any design or predetermined pattern. A grid measuring device 10 of this second embodiment can be shaped as the design or predetermined pattern and shaved into the beard of the first individual, such as the Batman logo shown in FIG. 6. A grid measuring device 10 of this second embodiment can also form graphic designs that are used to shave the hair on the first individual's head, as shown in FIG. 7.

Figure 8:
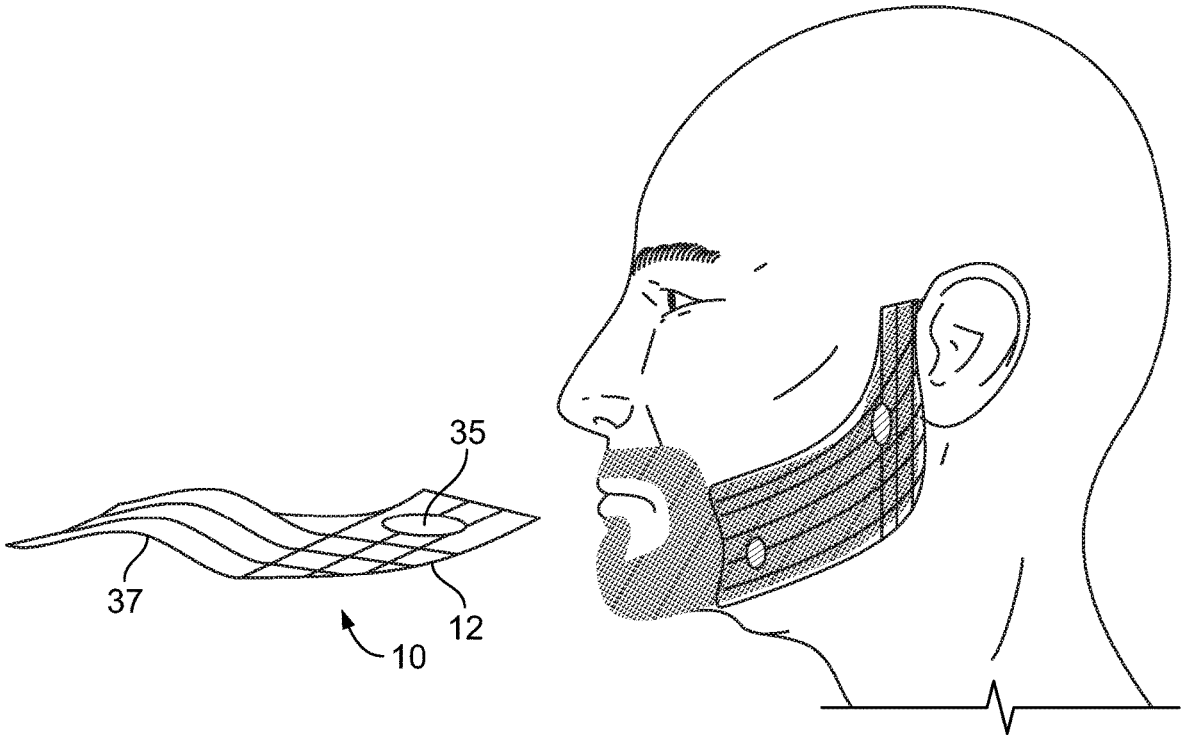
FIG. 8 is a side perspective view of a third embodiment of the hair grid measuring device of the present invention.

In a third embodiment of the present invention, shown in FIG. 8, the hair grid measuring device 10 comprises a three dimensional thin, flexible body 12 that includes a curved portion 37 extending upward and away from the edge of the body 12. When the device 10 is placed against the skin of the first individual, a pocket forms between the curved portion 37 and the skin allowing an increased amount of hair to remain, thereby allowing the user to grow more hair in certain areas.

Figure 10:
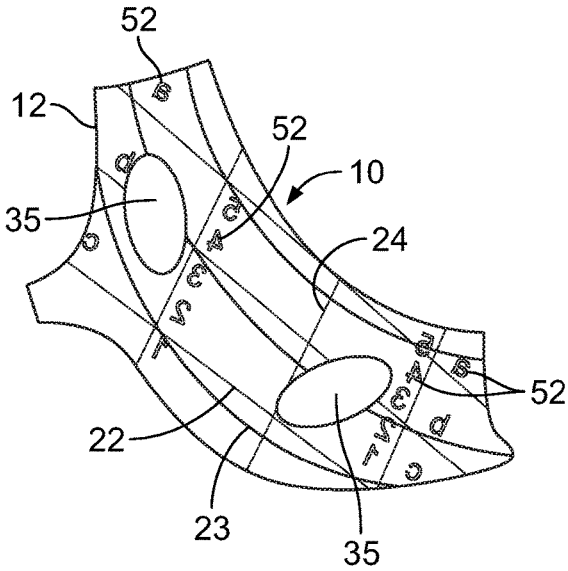
FIG. 10 is a front plan view of a fourth embodiment of the hair grid measuring device of the present invention.

In a fourth embodiment of the present invention, shown in FIG. 10, the hair grid measuring device 10 includes at least one inverted number, symbol, letter, and/or indicia 52 along at least one of the horizontal grid lines 22 and the vertical grid lines 24. The inverted numbers, symbols, letters, and/or indicia 52 make it suitable for the first individual to read number, symbol, letter, and/or indicia 52 correctly in the mirror.

The thin, flexible body 12 can be constructed of one of a number flexible materials, such as thin metal, thin, clear plastic, and an adhesive material. In one embodiment, the thin plastic can be either a thin, translucent plastic or a thin, transparent plastic. The clear plastic allows the first individual to accurately see the grid lines 22, 24 on their face through the grid measuring device 10. The material used should be able to be printed on or etched upon in order to mark the thin, flexible body 12 with grid lines 22, 24 and numbers. When using a thin metal material, the material should also be non-corrosive and rust proof.

The plurality of horizontal grid lines 22 and the plurality of vertical grid lines 24 are printed on or etched into the thin, flexible body 12 of the grid measuring device 10. The space between the horizontal grid lines 22 can decrease or remain constant as the horizontal grid lines 22 approach the third side 18 and fourth side 20 in the first embodiment, as shown in FIG. 2*a*, or any opposing side in the second embodiment. The space between the vertical grid lines 24 can also decrease or remain constant as the vertical grid lines 24 approach the first side 14 and second side 16. A scale can also be printed, inverted, on each side of the hair grid measuring device 10.

Figure 5B:
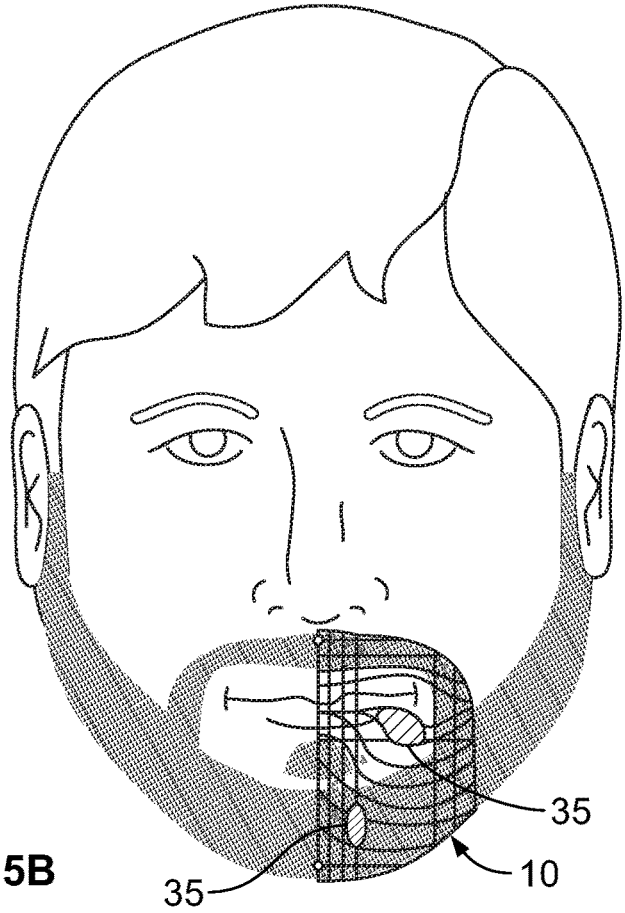
FIG. 5*b* is a front perspective view of the first embodiment of the chin grid of the hair grid measuring device having at least two apertures with a larger diameter to accommodate the first individual's fingers.

The thin, flexible body 12 includes a plurality of apertures 34, shown in FIGS. 1, 2*a*, 2*b*, 2*c*, 3*a*, and 4, that are adapted to receive and engage the post 36 of a fingertip holder 38 shown in FIGS. 3*a*-3*c*. The fingertip holder 38 includes the post 36 on one end and a semi-circular receiving cup 40 on the other end. The receiving cup 40 is adapted to receive the first individual's finger, allowing the first individual the ability to hold the grid measuring device 10 against the first individual's face, ensuring stability and leverage, and easily bending the grid measuring device 10 to the contours of the first individual's face, cheeks, neck, head, and body. Alternatively, at least two apertures 35 can have a larger diameter than apertures 34, shown in FIGS. 5*a*, 5*b*, and 10, to accommodate the first individual's fingers in order to hold the grid measuring device 10 in place.

The grid measuring device 10 can also include a non-permanent, water soluble writing device 42, shown in FIG. 2*e*, that allows the first individual to mark specific shaving points on their face through the apertures 34 to create custom designs. In addition, the grid measuring device 10 can include different measuring shapes and templates to create custom designs. The templates and designs can be customized to duplicate the hair of a second individual, including certain celebrities, actors, athletes, and fictional characters.

Use of the grid measuring device 10 described above is simple and straightforward. The first individual grasps the grid measuring device 10 and aligns the grid line 22, 24 of their choosing along the first individual's face, shown in FIG. 4, noting the number of the grid line that was aligned. While holding the grid measuring device 10 by the fingertip holder 38 to the first individual's face, the first individual shaves the skin that is not covered by the grid measuring device 10. The first individual then places the grid measuring device 10 on the other side of the first individual's face and aligns that same grid line 22, 24, that the first individual previously noted, along the first individual's face. Again, while holding the grid measuring device 10 by the fingertip holder 38 to the first individual's face, the first individual shaves the skin that is not covered by the grid measuring device 10. Alternatively, the first individual may hold the grid measuring device 10 by placing his fingers in apertures 35 and applying pressure against their face to keep the grid measuring device 10 in place while shaving. Use of the same grid lines 22, 24 on both sides of the first individual's face result in an accurate and symmetrical shave.

Figure 9B:
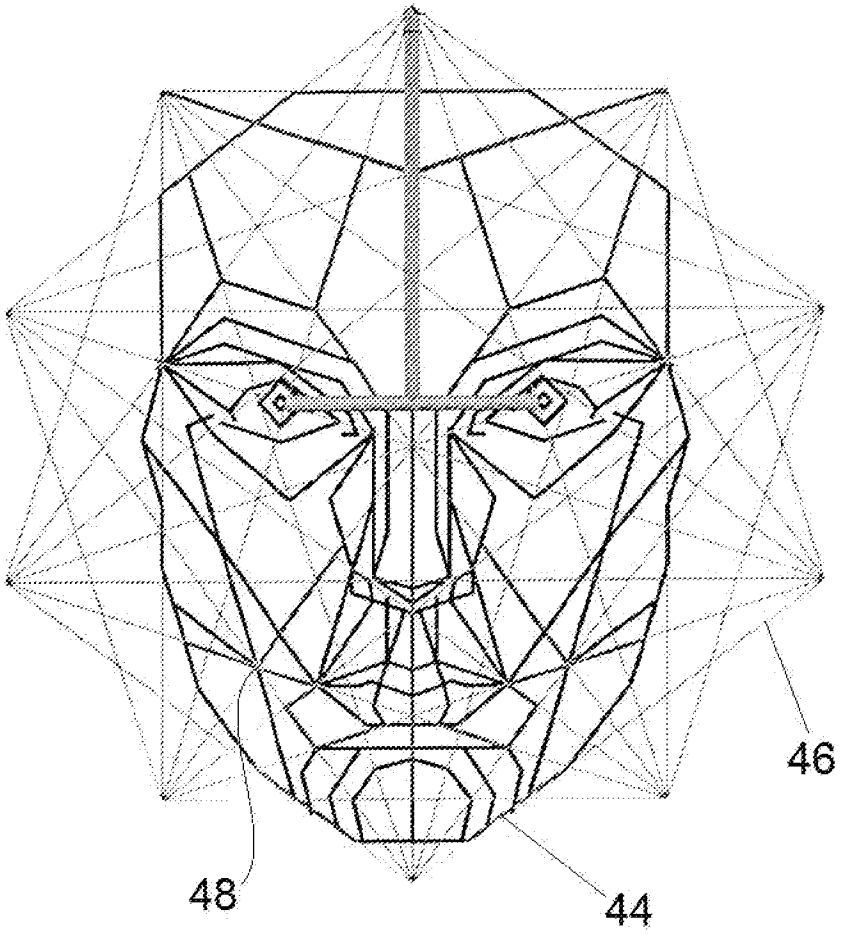
FIG. 9*b* is a front plan view of the grid comprising a plurality of points superimposed onto a second image of the first individual.
Figure 9A:
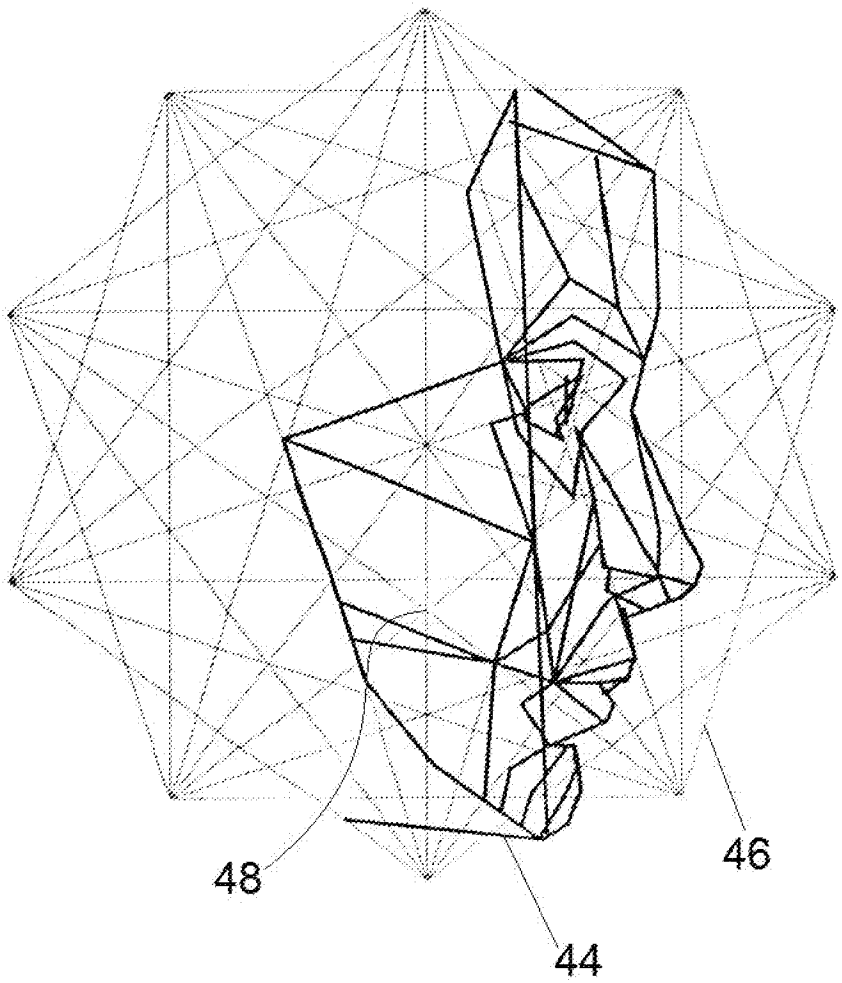
FIG. 9*a* is a front plan view of a grid comprising a plurality of points superimposed onto a first image of the first individual.
Figure 11:
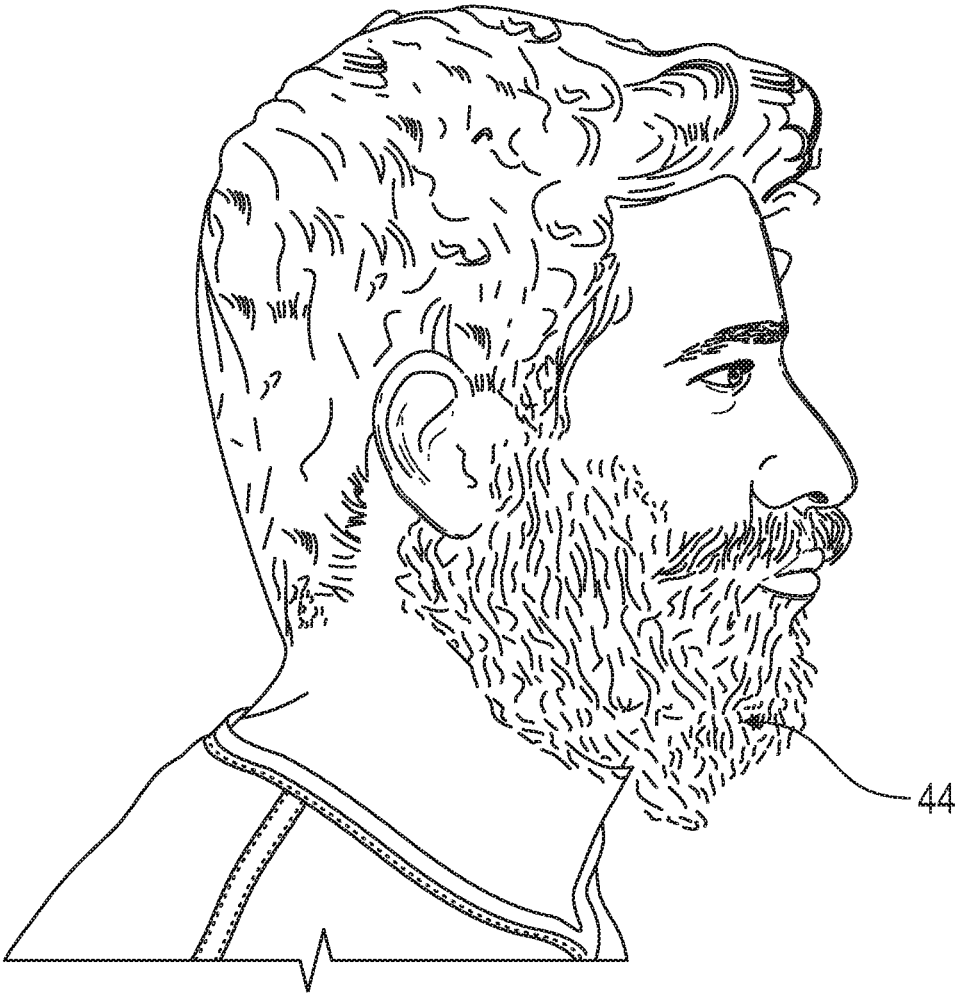
FIG. 11 is a side view of the first individual prior to using the hair grid measuring device of the present invention.
Figure 15:
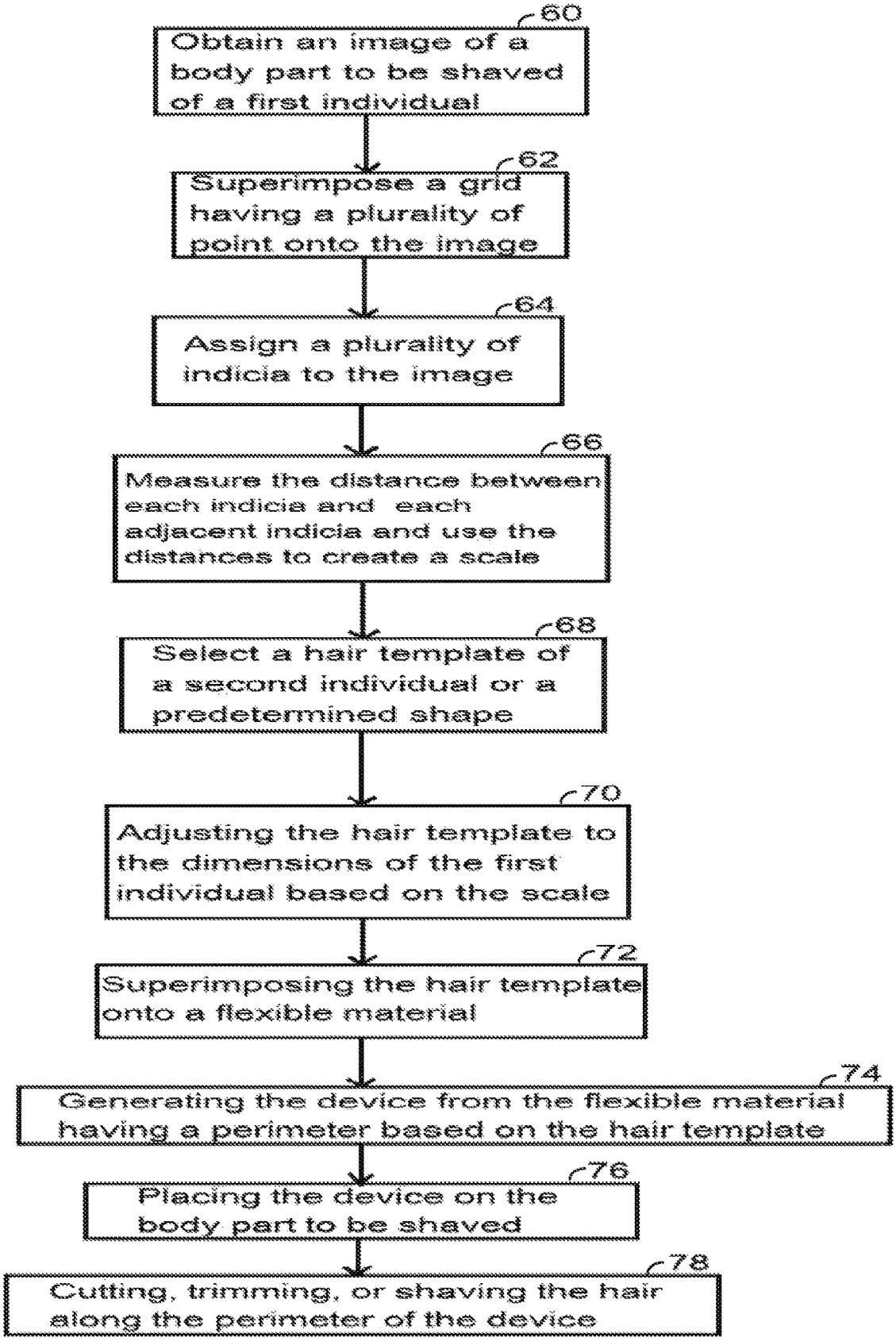
FIG. 15 is a flow diagram of a first embodiment of a method to create a custom hair style using the hair grid measuring device of the present invention.

A first embodiment of a method to create a custom hair style using a hair grid measuring device of the present invention, shown in FIG. 15, is accomplished either by hand or via a software application on an electronic device, such as a mobile electronic device or a computer. An image 44 of a first individual, shown in FIGS. 9*a*, 9*b*, and 11, is obtained using an optical device 60, such as a camera, scanner, or video recorder. The image 44 comprises the body part that the first individual wishes to shave. A grid 46 comprising a plurality of points 48 is superimposed onto the image 44 of the first individual 62, as shown in FIGS. 9*a* and 9*b*. A plurality of indicia 50 (not shown) is then assigned to the image based on at least one of the grid, the plurality of points, and the dimensions of the face or body part to be shaved of the first individual 64.

The plurality of indicia 50 corresponds to the plurality of key points 48 on the body part of the first individual, such as the eyes, nostrils, jawline, lips, philtrum, and cheekbones of the face. The distance between each indicia 50 and each adjacent indicia 50 is measured and that distance is used to create a scale custom to the first individual 66. A plurality of two dimensional planes can be generated based on the plurality of indicia 50, scaled to the first individual's dimensions. A hair template of a second individual is then selected 68 and adjusted to the dimensions of the face of the first individual based on the scale 70. The hair template of the second individual includes at least one of a beard, goatee, mustache, sideburns, soul patch, and eyebrows of the second individual. Alternatively, a hair template of any design or predetermined shape is selected 68 and adjusted to the dimensions of the face of the first individual based on the scale 70. One of the adjusted hair template of the second individual and the adjusted hair template of any design or predetermined pattern is superimposed onto a flexible material 72.

Figure 12:
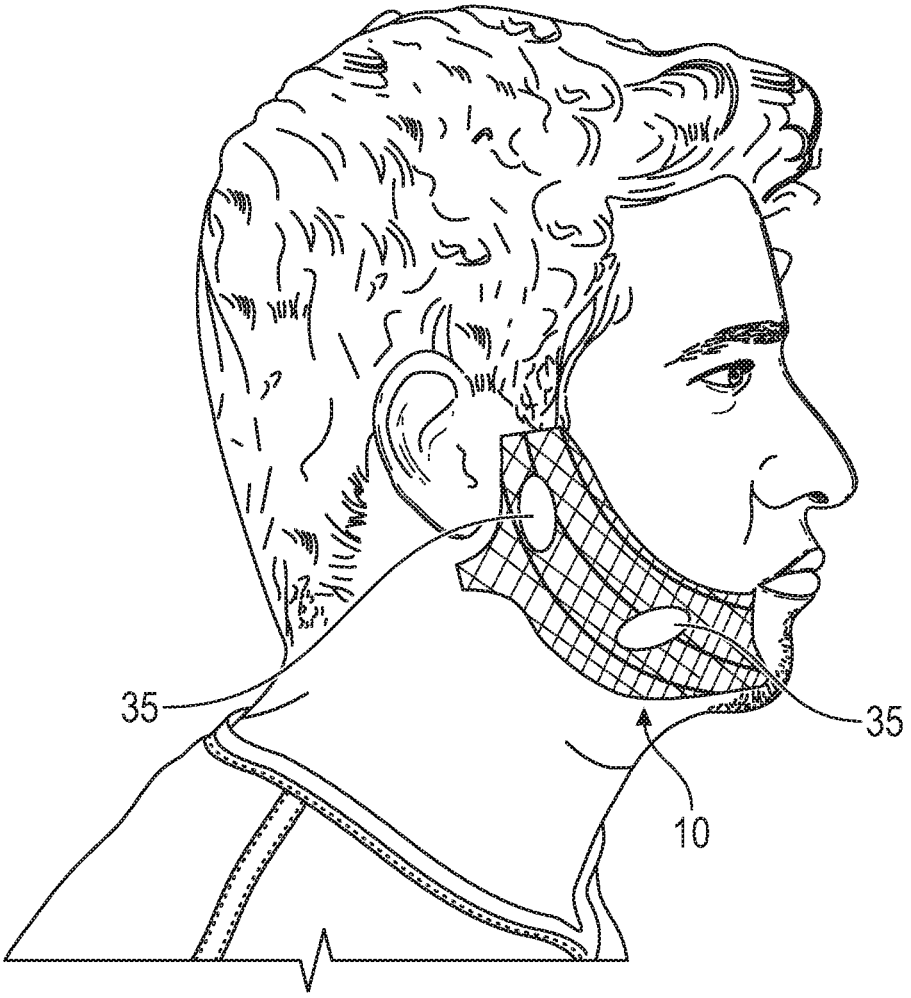
FIG. 12 is a side view of the first individual with the hair grid measuring device of the present invention placed on the face of the first individual.
Figure 13:
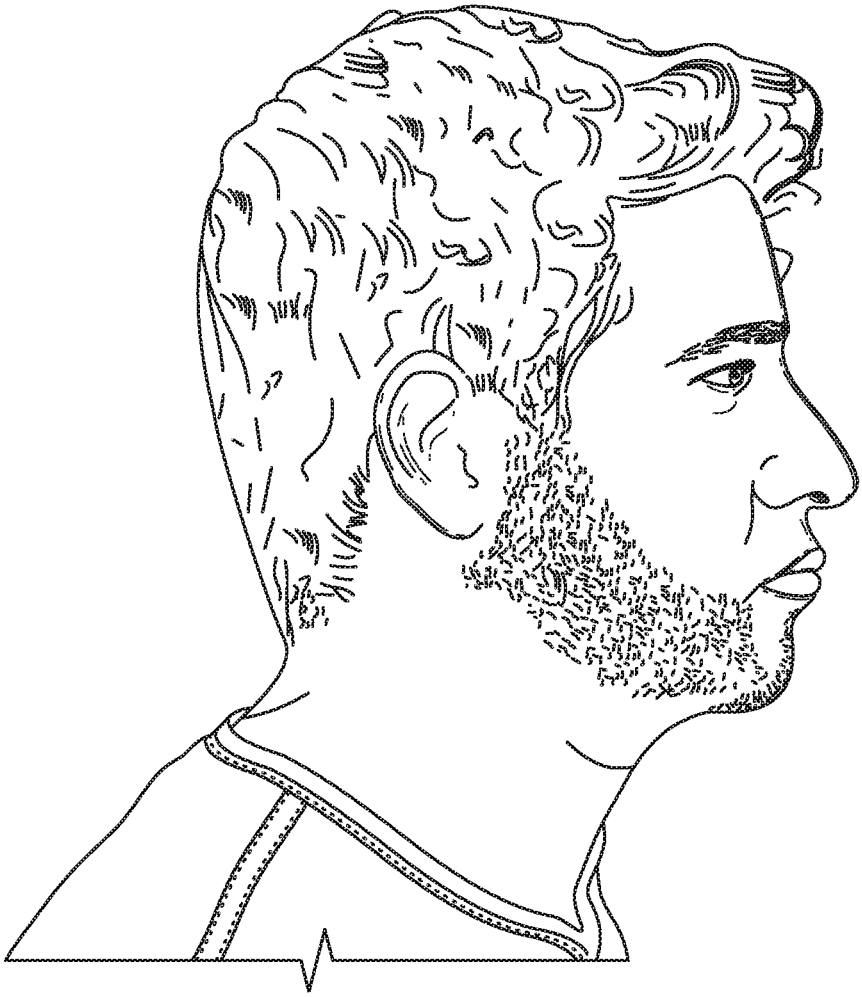
FIG. 13 is a side view of the first individual after using the hair grid measuring device of the present invention.
Figure 14:
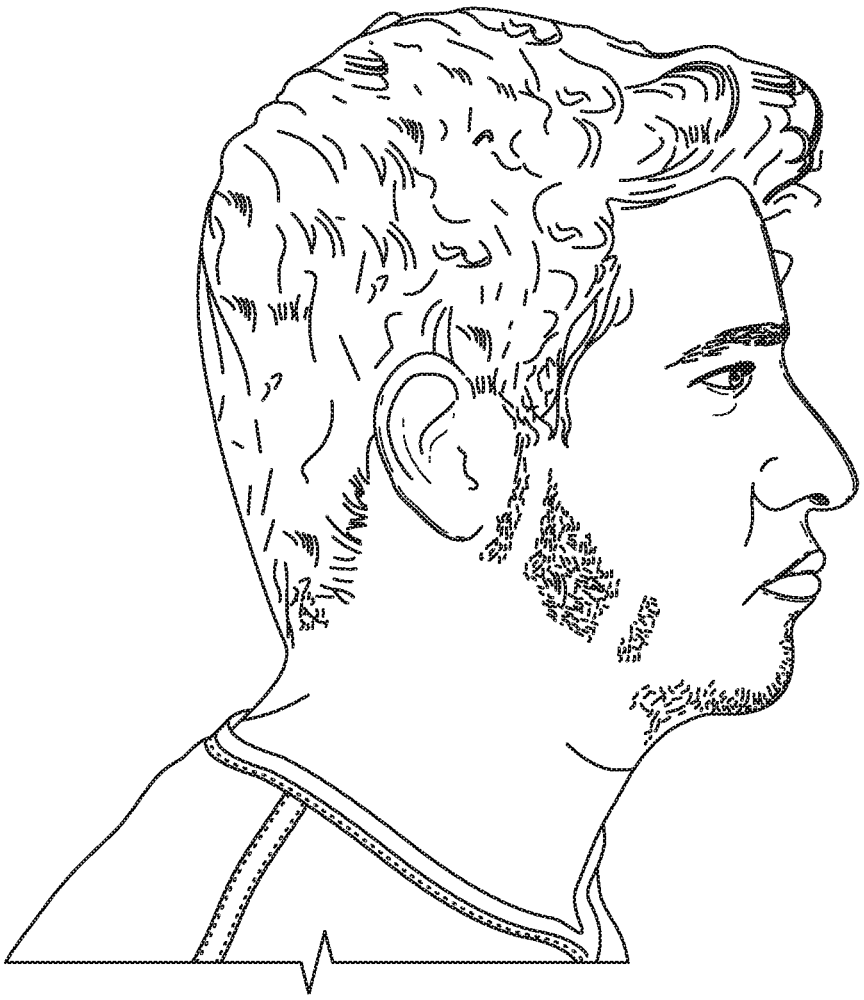
FIG. 14 is a side view of the first individual after using the hair grid measuring device of the present invention.

In the first embodiment, the hair grid measuring device 10, as shown in FIG. 10, is generated from the flexible material having a perimeter based on the dimensions of the adjusted hair template 74. The hair grid measuring device 10 is placed on the body part to be shaved of the first individual 76, as shown in FIG. 12 (shown without facial hair for clarity of the device 10), and secured to the body part of the first individual by placing the fingers of the first individual in at least two apertures 35 located in the hair grid measuring device or by placing the fingers of the first individual in at least one fingertip holder 38 attached to the hair grid measuring device. The hair of the first individual is then cut, trimmed, or shaved, as shown in FIG. 13, along the perimeter of the hair grid measuring device 78. Alternatively or additionally, the hair of the first individual is cut, trimmed, or shaved along the perimeter outlined by the combination of indicia on the hair grid measuring device, as shown in FIG. 14.

Figure 16:
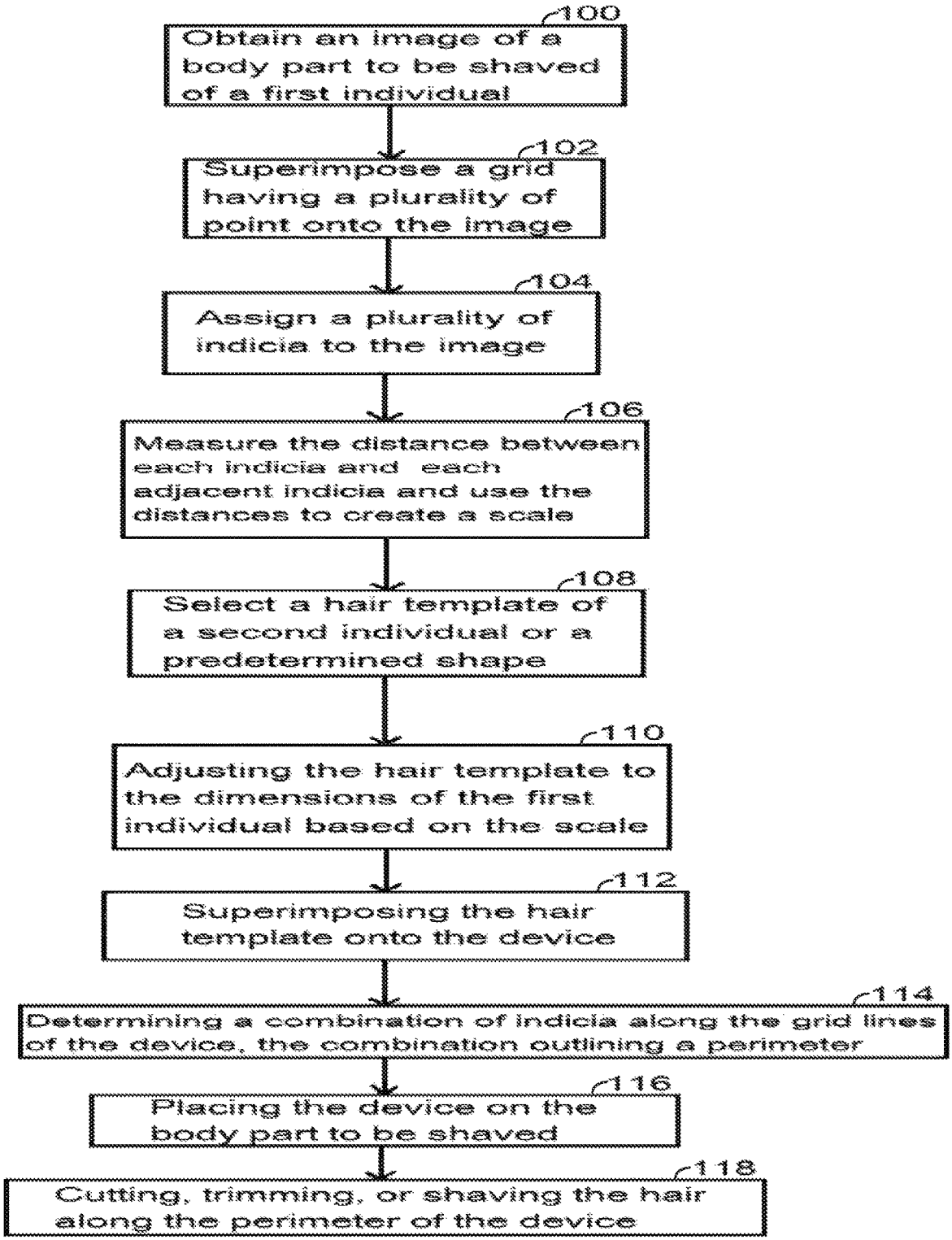
FIG. 16 is a flow diagram of a second embodiment of a method to create a custom hair style using the hair grid measuring device of the present invention.

A second embodiment of the method to create a custom hair style using a hair grid measuring device of the present invention, shown in FIG. 16, is accomplished either by hand or via a software application on an electronic device, such as a mobile electronic device or a computer. An image 44 of a first individual, shown in FIGS. 9*a*, 9*b*, and 11, is obtained using an optical device 100, such as a camera, scanner, or video recorder. The image 44 comprises the body part that the first individual wishes to shave. A grid 46 comprising a plurality of points 48 is superimposed onto the image 44 of the first individual 102, as shown in FIGS. 9*a* and 9*b*. A plurality of indicia 50 (not shown) is then assigned to the image based on at least one of the grid, the plurality of points, and the dimensions of the face or body part to be shaved of the first individual 104.

The plurality of indicia 50 corresponds to the plurality of key points 48 on the body part of the first individual, such as the eyes, nostrils, jawline, lips, philtrum, and cheekbones of the face. The distance between each indicia 50 and each adjacent indicia 50 is measured and that distance is used to create a scale custom to the first individual 106. A plurality of two dimensional planes can be generated based on the plurality of indicia 50, scaled to the first individual's dimensions. A hair template of a second individual is then selected 108 and adjusted to the dimensions of the face of the first individual based on the scale 110. The hair template of the second individual includes at least one of a beard, goatee, mustache, sideburns, soul patch, and eyebrows of the second individual. Alternatively, a hair template of any design or predetermined shape is selected 108 and adjusted to the dimensions of the face of the first individual based on the scale 110.

The adjusted hair template is superimposed onto a hair grid measuring device 112 and a combination of indicia is determined from the plurality of indicia 50 along the grid lines 22, 24 of the hair grid measuring device 114. The combination of indicia comprises a set of steps that outlines a perimeter based on the dimensions of the adjusted hair template of the second individual or the adjusted hair template of any design or predetermined pattern. The hair template can be further adjusted and scaled down when the first individual lacks hair in areas required by the hair template. The adjusted hair template and the hair grid measuring device, and their perimeter, can each be saved in electronic form to allow for reproduction onto stickers or other material.

The hair grid measuring device 10 is placed on the body part to be shaved of the first individual 116, as shown in FIG. 12 (shown without facial hair for clarity of the device 10), and secured to the body part of the first individual by placing the fingers of the first individual in at least two apertures 35 located in the hair grid measuring device or by placing the fingers of the first individual in at least one fingertip holder 38 attached to the hair grid measuring device. The hair of the first individual is then cut, trimmed, or shaved, as shown in FIG. 13, along the perimeter of the hair grid measuring device 118. Alternatively or additionally, the hair of the first individual is cut, trimmed, or shaved along the perimeter outlined by the combination of indicia on the hair grid measuring device, as shown in FIG. 14.

The foregoing description of an illustrated embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

What is claimed is:

1. A hair grid measuring device for shaving a user's face, comprising:

a. a thin flexible chin grid body having a first peripheral edge defining a first terminal edge of the hair grid measuring device, a second peripheral edge, a third peripheral edge, and a fourth peripheral edge, the chin grid body formed between and surrounded by each peripheral edge and configured to be placed over and conform to at least a portion of a user's chin;

b. a thin flexible curved jaw grid body extending upward and away from the second peripheral edge of the chin grid body and having a first peripheral edge continuous with the second peripheral edge of the chin grid body, a second peripheral edge defining a second terminal edge of the hair grid measuring device, a third peripheral edge continuous with the third peripheral edge of the chin grid body to form a curved upper terminal edge of the hair grid measuring device and a fourth peripheral edge continuous with the fourth peripheral edge of the chin grid body to form a curved lower terminal edge of the hair grid measuring device, the curved jaw grid body being integral with the chin grid body and being configured to be placed over and conform to at least a portion of a user's jaw;

c. a plurality of labeled horizontally angled grid lines extending continuously through the chin grid body and the curved jaw grid body from the first peripheral edge of the chin grid body to the second peripheral edge of the curved jaw grid body, and a plurality of labeled vertical grid lines extending continuously through the chin grid body and the jaw grid body from the third peripheral edges to the fourth peripheral edges thereof, wherein the plurality of labeled horizontally angled grid lines and the plurality of labeled vertical grid lines intersect to form a grid;

d. each labeled horizontally angled grid line and labeled vertical grid line including at least one inverted indicia, each at least one inverted indicia comprising one of an inverted number, inverted symbol and inverted letter appearing non-inverted when viewed in a mirror;

e. a plurality of marking apertures extending through each of the chin grid body and the curved jaw grid body, the plurality of marking apertures located at the intersections of the plurality of labeled horizontal grid lines and the plurality of labeled vertical grid lines, the plurality of spaced apertures adapted to provide access to a marker to mark the skin of a user through at least one of the plurality of spaced apertures, creating a desired pattern on the skin of a first individual; and f. at least two finger apertures having a larger diameter than a diameter of the plurality of marking apertures, wherein the at least two finger apertures serve to accommodate a user's fingers to hold the grid measuring device in place against the user's face.

2. The hair grid measuring device of claim 1, wherein:

the first peripheral edge is opposite said second peripheral edge, said first peripheral edge including a first length and the second peripheral edge including a second length; and the third peripheral edge is opposite the fourth peripheral edge, the third peripheral edge including a third length and the fourth peripheral edge including a fourth length, the first length and the second length are one of shorter than and equal to the third length and the fourth length.

3. The hair grid measuring device of claim 1, wherein the thin, flexible chin grid body and the thin, flexible curved jaw grid body are constructed from one of thin metal and thin plastic.

4. The hair grid measuring device of claim 3, wherein the thin plastic is one of translucent plastic and transparent plastic.

5. The hair grid measuring device of claim 1, wherein the plurality of labeled horizontally angled grid lines and the plurality of labeled vertical grid lines are one of printed on and etched into the chin grid body and the jaw grid body.

6. The hair grid measuring device of claim 1, wherein a distance between each labeled horizontally angled grid line of the plurality of labeled horizontally angled grid lines one of decreases and remains constant as the horizontally angled grid lines approach at least one of the first and second peripheral edge of the chin grid body.

7. The hair grid measuring device of claim 1, wherein a distance between each labeled vertical grid line of the plurality of labeled vertical grid lines one of decreases and remains constant as the vertical grid lines approach at least one of the third and fourth peripheral edge of the chin grid body.

8. The hair grid measuring device of claim 1, further comprising:

at least one fingertip holder comprising a semicircular receiving end and a post laterally extending from an external surface of the chin grid body or the jaw grid body, the post including a first end removably disposed within an aperture of the plurality of marking apertures and a second end attached to the receiving end a predetermined distance from the external surface of the chin grid body or the jaw grid body, the receiving end adapted to receive the first individual's finger.

9. The hair grid measuring device of claim 1, wherein the first and second peripheral edges of the chin body and the jaw grid body are one of curved and straight.

* * * * *